US006478011B2

(12) United States Patent
Paffrath

(10) Patent No.: US 6,478,011 B2
(45) Date of Patent: Nov. 12, 2002

(54) AIR INTAKE DEVICE FOR AN INTERNAL COMBUSTION ENGINE

(75) Inventor: Holger Paffrath, Pulheim (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/898,444

(22) Filed: Jul. 5, 2001

(65) Prior Publication Data

US 2002/0023620 A1 Feb. 28, 2002

(30) Foreign Application Priority Data

Jul. 5, 2000 (DE) ..... 100 32 740

(51) Int. Cl.[7] ..... F02D 9/00
(52) U.S. Cl. ..... 123/336; 123/337; 251/305
(58) Field of Search ..... 123/336, 337, 123/319, 311; 251/305

(56) References Cited

U.S. PATENT DOCUMENTS

| | | | | | |
|---|---|---|---|---|---|
| 4,284,264 | A | * | 8/1981 | Hubertson | 251/305 |
| 5,657,731 | A | * | 8/1997 | Kim | 123/336 |
| 6,016,780 | A | | 1/2000 | Fischer | |
| 6,257,202 | B1 | * | 7/2001 | Ohta et al. | 123/337 |
| 6,263,917 | B1 | * | 7/2001 | Evans | 137/595 |

* cited by examiner

*Primary Examiner*—Bibhu Mohanty
(74) *Attorney, Agent, or Firm*—Crowell & Moring LLP

(57) ABSTRACT

An air intake device for an internal combustion engine with at least two intake pipes, wherein each intake pipe can be closed by at least one throttle valve and wherein the throttle valves are connected to one another. The throttle valves are soft in at least one area in such a way that unevenness in the distribution of the supplied air is reduced.

6 Claims, 1 Drawing Sheet

AIR INTAKE DEVICE FOR AN INTERNAL COMBUSTION ENGINE

BACKGROUND OF THE INVENTION

The present invention relates to an air intake device for an internal combustion engine comprising at least two intake pipes, each pipe being closed by at least one throttle valve, and the throttle valves being interconnected.

An air intake device for an internal combustion engine is disclosed in Fischer, U.S. Pat. No. 6,016,780. This air intake device has a header, which is connected to the cylinders of the internal combustion engine via intake pipes. The intake pipes are closed by a pivoted flap having three blades. Variably effective intake pipe lengths are realized by appropriate switching of the pivoted flap.

Especially in internal combustion engines, reliable closing of the flaps is required to fill the cylinders evenly. Various measures are taken to accomplish this. The flaps can be injection molded directly into the duct in an assembly injection molding process. The flaps can also be provided with rubber sealing lips, or sealing rings can be arranged accordingly. When several flaps are coupled to a common actuator, the coupling member must be carefully adjusted so that the individual flaps open and close uniformly. In many cases, the flaps and their housing are made of metal in a very complex and costly manner to keep the gap on the throttle valves and on all flaps as uniform and/or small as possible.

SUMMARY OF THE INVENTION

It is an object of the invention to provide an air intake device which alleviates or overcomes the foregoing difficulties.

Another object of the invention is to provide an air intake device for an internal combustion engine having throttle valves, which ensure an even distribution of the amount of air supplied to the cylinders.

It is also an object of the invention to provide an air intake device which promotes reliable closing of a plurality of flap valves and nevertheless can be economically manufactured.

These and other objects are achieved by the invention as described and claimed hereinafter.

In accordance with one aspect of the invention, the objects are achieved by providing an air intake device for supplying air to an internal combustion engine having at least two intake pipes and at least one throttle valve for closing each intake pipe, wherein the throttle valves are interconnected, and the throttle valves have a soft or deformable structure in at least one area in such a way that uneven distribution of the supplied air is reduced.

In accordance with another aspect of the invention, the objects are achieved by providing an air intake device for an internal combustion engine having at least two intake pipes and at least one throttle valve for closing each intake pipe, wherein the throttle valves are arranged off center on shafts and are interconnected, and wherein the individual shafts are each connected to a control rod via an elastically resilient connecting element provided between the individual shaft and the control rod.

Uneven distribution in the air supply to an internal combustion engine can be caused, for instance, by gaps between valve flaps and associated valve seats that differ from cylinder to cylinder. In the case of multi-cylinder engines where several individual flaps are mounted with individual shafts, the flap positions may differ slightly from cylinder to cylinder. Even deviations in the housing geometry, which in this case may also include the resonator tube geometry, may cause uneven air distribution. If the gaps available to the air that flows into the cylinders differ from cylinder to cylinder for any of the aforementioned reasons, then each cylinder receives a different and undefined amount of fresh air. The consequences of uneven air supply distribution may include high exhaust emissions or rough running of the engine. The invention has the advantage of eliminating this uneven distribution.

In accordance with the present invention, the throttle valves have a defined softness or deformability at some locations, which reduces uneven distribution. This configuration is based on the following reasoning: if one cylinder takes in less air than another, then the pressure pattern behind the throttle valve differs for that cylinder. The cylinder that takes in the least amount of air because it has the smallest gap or opening has the lowest pressure behind the throttle valve. Since the pressure in front of the throttle valve is the same in all cylinders, the pressure difference across the flap is greatest in the cylinders that have the smallest opening. If this pressure difference can be used to deform the flap and enlarge the opening, then this cylinder will take in more air. In an ideal case, uneven distribution will be eliminated.

According to one embodiment of the invention, the flap in its closed position is not perpendicular to the center axis of the resonance tube. When the valve is closed starting from the fully open position, the end position should be attained before a perpendicular orientation is reached. The valve should be as rigid as possible in the area of the shaft and the shaft itself should be torsionally stiff. It is sufficient if the throttle valve has one soft or deformable portion.

According to a further embodiment of the invention, this partial area can be realized in that the blade of the throttle valve which is inclined in flow direction is flexible compared to the other blade.

In an alternative air intake device for an internal combustion engine, the shafts of the throttle valves are arranged off-center. The individual shafts of these throttle valves are connected to a control rod. Between each individual shaft and the control rod, a resiliently elastic connecting element is provided. This element has the task of compensating the uneven distribution of the supplied air; i.e., mobility is provided by the elastic element rather than by a soft throttle valve.

In a further embodiment of the invention, the control rod can be moved in a linear or a rotary motion.

These and other features of preferred embodiments of the invention, in addition to being set forth in the claims, are also disclosed in the specification and/or in the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
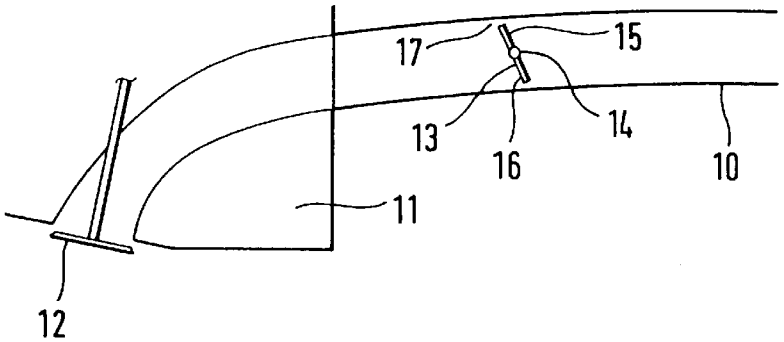
FIG. 1 is a schematic representation of an air intake device.

The air intake device according to FIG. 1 shows a single intake pipe 10 leading to a cylinder head 11 of an internal combustion engine. The intake valve 12 is illustrated schematically in the cylinder head. A throttle valve 13 is arranged in the intake pipe 10. The throttle valve is depicted in its nearly closed position. In this position it diverges from the perpendicular in relation to the flow direction. The throttle valve is rigid in the area of the shaft 14 and the shaft itself is torsionally stiff. If pressure is applied to the flap in flow direction, assuming that both blades of the flap are soft, one blade 15 would be bent in the direction of flow and the other blade 16 would be pressed against the housing wall. The blade that would be pressed against the housing wall should also be as stiff as possible so that it does not further reduce the gap on this side as it is pressed against the housing. The other blade ensures that the gap 17 is slightly enlarged through deformation so that more air can flow into the cylinder. The effect can be enhanced by a targeted configuration of the housing contour. The detail design of the flap and the housing must be readjusted for each engine. This design depends, among other things, on the cylinder stroke volume, the resonance tube diameter and the distance between the intake valve and the individual throttle valve. The direction of rotation in which the throttle valve opens or closes can be selected at will.

Figure 2:
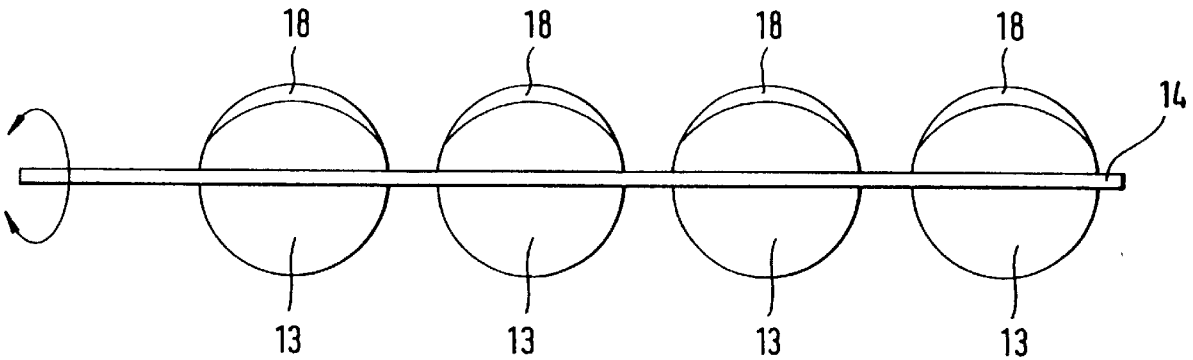
FIG. 2 is a schematic sketch of individual throttle valves on a single shaft.

FIG. 2 shows a plurality of individual throttle valves that are mounted on a common shaft. Here, too, the shaft has high torsional stiffness. The individual throttle valves are relatively soft in their upper region 18. This can be achieved, for instance, by a two-component injection molding process or by reducing the wall thickness.

Figure 3:
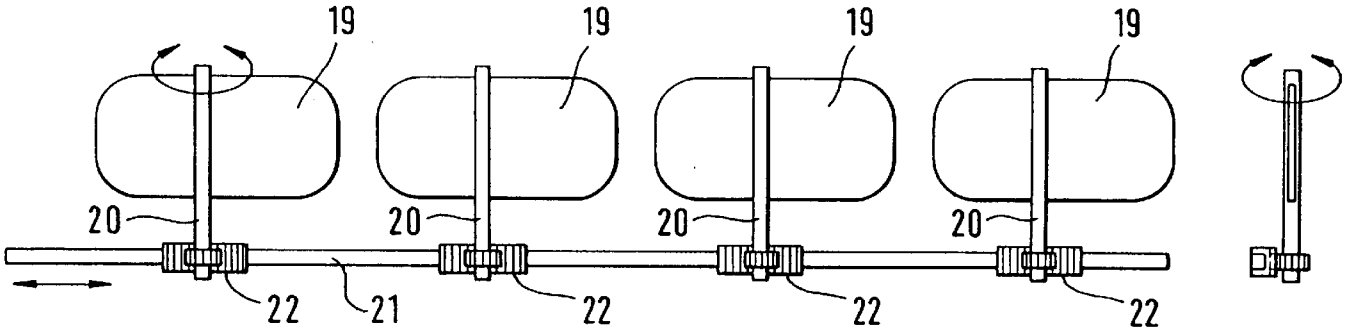
FIG. 3 is a schematic sketch of individual throttle valves with individual shafts.

FIG. 3 shows individual throttle valves 19 in which the individual flaps are not mounted on a single shaft. These are systems in which each individual throttle valve 19 has its own shaft 20. The individual shafts 20 are operated collectively and synchronously via a control rod to which all the shafts of the individual throttle valves are connected. The individual flaps are perpendicular to the control rod.

In this case, there is another option to achieve the goal of a soft configuration of the throttle valve. The flaps should not be mounted completely relieved from pressure. Due to a slightly off-center position of the shafts, each individual flap tends to open when pressure is applied. The flap that is subject to the greatest pressure load reaches the highest torque around the shaft of the flap. A pressure load that differs from flap to flap is caused by different leakage at the individual flaps. The tightest flap allows the least amount of air to pass; the pressure behind it drops the most. The pressure load of this flap is greatest. At the point where an individual shaft is connected to the control rod, an elastic element 22 is necessary to counteract the torque of the flap. If the flaps are unloaded, the elastic element 22 ensures that all flaps assume a defined position at a limit stop on the rod. If the torque of the shaft exceeds the bias of the spring, the flap can move away from this limit stop position, while the position of the control rod remains constant. The individual flaps, depending on the pressure exerted on the flaps, can assume different positions within a narrow range while the position of the control rod remains constant. The valve with the greatest torque as a result of the smallest gap will move the farthest from its normal position and will thus enlarge the gap at this flap. More air will reach this cylinder.

The separate position of each valve is a function of its gap dimension. Ideally, no uneven cylinder distribution will occur in this system.

The control rod 21 can be moved in a linear or rotary motion, i.e., the connection to the individual flaps can be gearing or a lever, for instance. The elastic element, which connects one of the shafts to the control rod, can be embodied in many different ways. The simplest way is to realize this elastic element by means of an elastic coupling member.

The individual throttle valves can either be produced separately by means of a throttle housing and be flange-mounted to the resonance tube as close as possible to the cylinder head. The throttle valves may also be built directly into the resonance tube in an assembly injection molding process. The throttling of the engine can be effected either solely by means of the individual throttle valves or by a combination of individual and central throttle valves.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. An air intake device for supplying air to an internal combustion engine having at least two intake pipes and at least one throttle valve for closing each intake pipe, wherein the throttle valves are interconnected, and the throttle valves are soft in at least one area in such a way that uneven distribution of the supplied air is reduced.

2. An air intake device according to claim 1, wherein each throttle valve in its closed position lies at an angle to a plane perpendicular to the flow direction of the supplied air.

3. An air intake device according to claim 1, wherein each throttle valve is rigidly mounted on a torsionally stiff shaft and comprises a blade portion on which the soft area is arranged.

4. An air intake device according to claim 3, wherein the blade of the throttle valve that is inclined the direction of air flow is more flexible than the other blade.

5. An air intake device for an internal combustion engine having at least two intake pipes and at least one throttle valve for closing each intake pipe, wherein the throttle valves are arranged off center on shafts and are interconnected, and wherein the individual shafts are each connected to a control rod via an elastically resilient element provided between the individual shaft and the control rod.

6. An air intake device according to claim 5, wherein the control rod can move in a linear or rotary motion.

* * * * *